US006190087B1

(12) United States Patent
Röwer

(10) Patent No.: US 6,190,087 B1
(45) Date of Patent: Feb. 20, 2001

(54) SCREED FOR A PAVER

(75) Inventor: Helmut Röwer, Obernkirchen (DE)

(73) Assignee: ABG Allgemeine Baumaschinen-Gesellschaft mbH, Hameln (DE)

( * ) Notice: Under 35 U.S.C. 154(b), the term of this patent shall be extended for 0 days.

(21) Appl. No.: 09/361,013

(22) Filed: Jul. 23, 1999

(30) Foreign Application Priority Data

Jul. 24, 1998 (DE) ..... 198 33 394

(51) Int. Cl.[7] ..... E01C 19/22; F16D 3/80; F16D 17/00

(52) U.S. Cl. ..... 404/104; 404/118; 403/31

(58) Field of Search ..... 404/96, 101, 104, 404/118; 403/31, 353

(56) References Cited

U.S. PATENT DOCUMENTS 4,090,731 * 5/1978 Bopp et al. ..... 296/28 C
4,493,585 * 1/1985 Axer ..... 404/102
5,116,382 * 5/1992 Steinkamp et al. ..... 623/38
5,143,331 * 9/1992 Robert ..... 248/27.1
5,203,642 * 4/1993 Heller et al. ..... 404/118
5,308,190 * 5/1994 Raymond ..... 404/95
5,344,254 * 9/1994 Sartain ..... 404/104
5,924,819 * 7/1999 Breidenbach ..... 404/96
6,074,118 * 6/2000 Ferrari et al. ..... 403/31
6,079,893 * 6/2000 Seidl et al. ..... 403/15
6,089,674 * 7/2000 Whitman ..... 301/111

* cited by examiner

*Primary Examiner*—Eileen D. Lillis
*Assistant Examiner*—Gary S. Hartmann
(74) *Attorney, Agent, or Firm*—Mark A. Ussai

(57) ABSTRACT

A paver screed has a main screed with two outer side walls, at least one of the side walls being provided with insertion orifices for the releasable mounting of at least one lateral screed extension by means of fastening elements capable of being inserted through the insertion orifices. A screed extension has fastening elements that comprise hydraulic cylinders which each have a piston that is spring-biased into an initial, retracted position. The cylinders are actuated by hydraulic fluid to displace or extend the piston against the biasing action of the spring. Preferably, the hydraulic cylinders are connected a hydraulic circuit of the main screed. The piston of each hydraulic cylinder carries a shank capable of being inserted through a proximal insertion orifice and which are preferably provided with an abutment element configured for attaching the cylinder to the sidewall of the main screed.

18 Claims, 3 Drawing Sheets

SCREED FOR A PAVER

BACKGROUND OF THE INVENTION

The present invention relates to a screed for a paver, and more particularly to a paver screed having screed extensions.

Paving machines or pavers generally include a screed which is disposed at the rear of the machine chassis and located behind a distributor auger. Such screeds are typically articulated on the chassis via a pair of tension arms, such that the screed "floats" on the material being laid or paved. In order to enable the screed to be used to pave surfaces having relatively greater working widths, it is known to attach screed lengthening parts or "screed extensions" manually on each side of a main screed. To again pave a surface at the normal width of the main screed, these screed extensions are then manually removed from the main screed.

Such screed extensions are normally mounted onto the main screed by means of threaded fasteners (i.e., fastening screws or bolts) which extend through insertion orifices or mounting holes provided in a side wall of the main screed, such side wall being located at the end of the main screed where an increase in length is desired. Further, the fasteners also typically extend through bores or mounting holes provided in a side wall of the screed extension being mounted, the holes on the extension being substantially aligned with the holes on the main screed. Generally, several threaded fasteners are required to mount a single screed extension, and often multiple extensions are attached to each end of the main screed, depending on the desired overall length of the screed assembly. When it is desired to pave a material mat having a lesser width, as discussed above, the screed extensions must then be removed from the main screed, requiring the removal of numerous threaded fasteners.

Although the above-described extension mounting/removing process is generally effective for varying the overall width of a screed assembly, this process is relatively time-consuming and requires a substantial effort by the person fitting or attaching the screed extension (i.e., the paver operator or a paving crew member). Therefore, it is desirable to provide screed extensions for a screed assembly that may be mounted quickly and with little effort by the paver operators/crew members.

SUMMARY OF THE INVENTION

In one aspect, the present invention is a screed for a paver. The screed has a hydraulic circuit and two outer side walls, at least one of the side walls being provided with an insertion orifice configured for releasable mounting of at least one lateral screed lengthening part. Further, a screed lengthening part has a fastening element capable of being inserted through the insertion orifices. The fastening element comprises a spring accumulator cylinder, the cylinder having a piston spring-loaded into an initial position, being actuatable hydraulically to displace the piston against the spring load and connectable to a hydraulic circuit of the screed. A shank is mounted to the piston and is capable of being inserted through the insertion orifice and being providable with an abutment element.

In another aspect, the present invention is a screed extension for a screed assembly having a main screed. The main screed has two outer side walls, at least one of the side walls having at least one mounting hole. A hydraulic circuit is disposed on the main screed. The screed extension comprises a body having a sidewall and a hydraulic cylinder mounted on the sidewall. The hydraulic cylinder is connectable to the hydraulic circuit of the main screed and has a piston. The piston is spring-loaded into an initial position and has a shank with an abutment portion engageable with the mounting hole of the main screed so as to connect the screed extension with the main screed.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figures 1, 2:
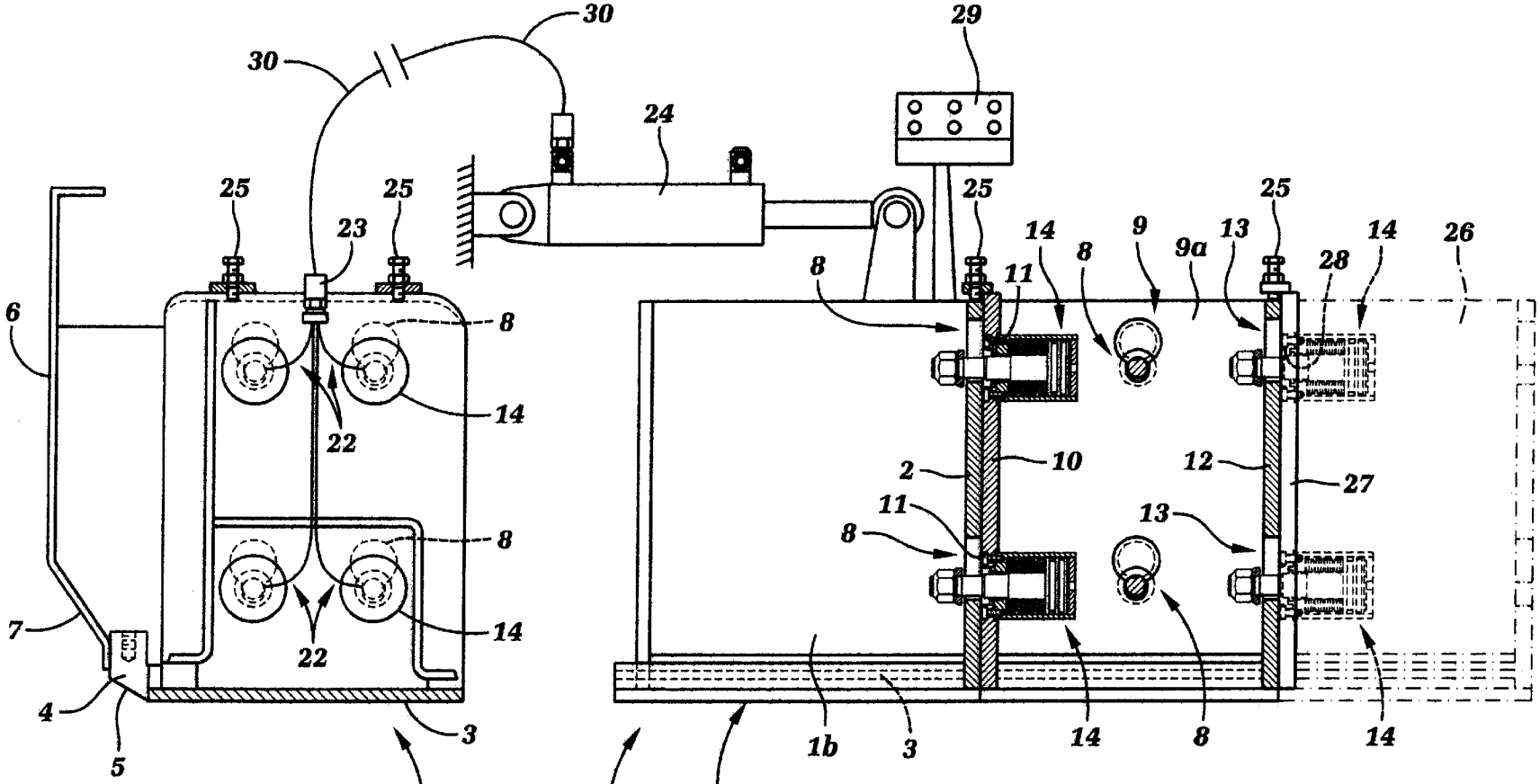
FIG. 1 is a side plan view of a screed assembly for a paver.
FIG. 2 is a partial rear plan view a main screed section, showing an extendible screed and screed extensions in accordance with the present invention mounted thereon.

Certain terminology is used in the following description for convenience only and is not limiting. The words "right", left", "lower", "upper", "upward", "down" and "downward" designate directions in the drawings to which reference is made. The words "front", "frontward" and "rear", "rearward" refer to directions toward and away from, respectively, either the direction of paving or a designated front section of a screed assembly (or a specific portion thereof), the particular meaning intended being readily apparent from the context of the description. The terminology includes the words specifically mentioned above, derivatives thereof, and words of similar import.

Figure 4:
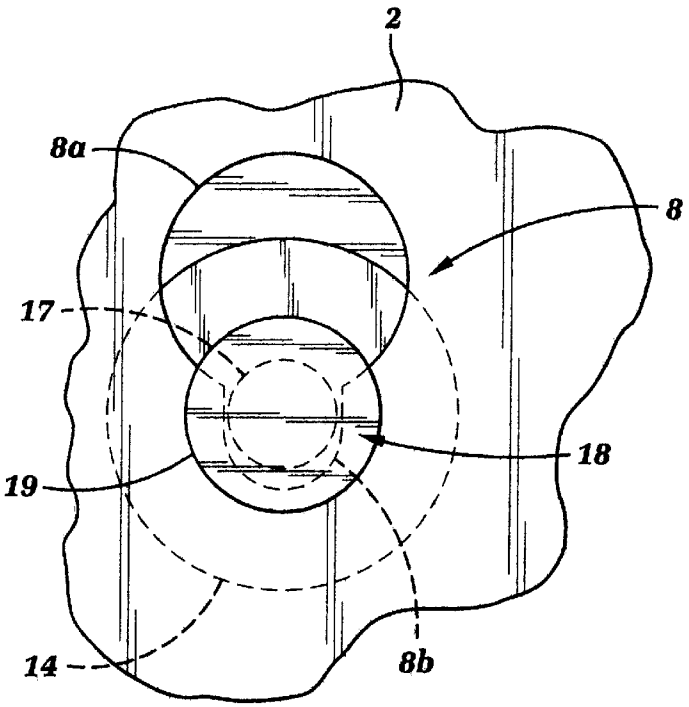
FIG. 4 is a side view of the detail of FIG. 3.
Figure 5:
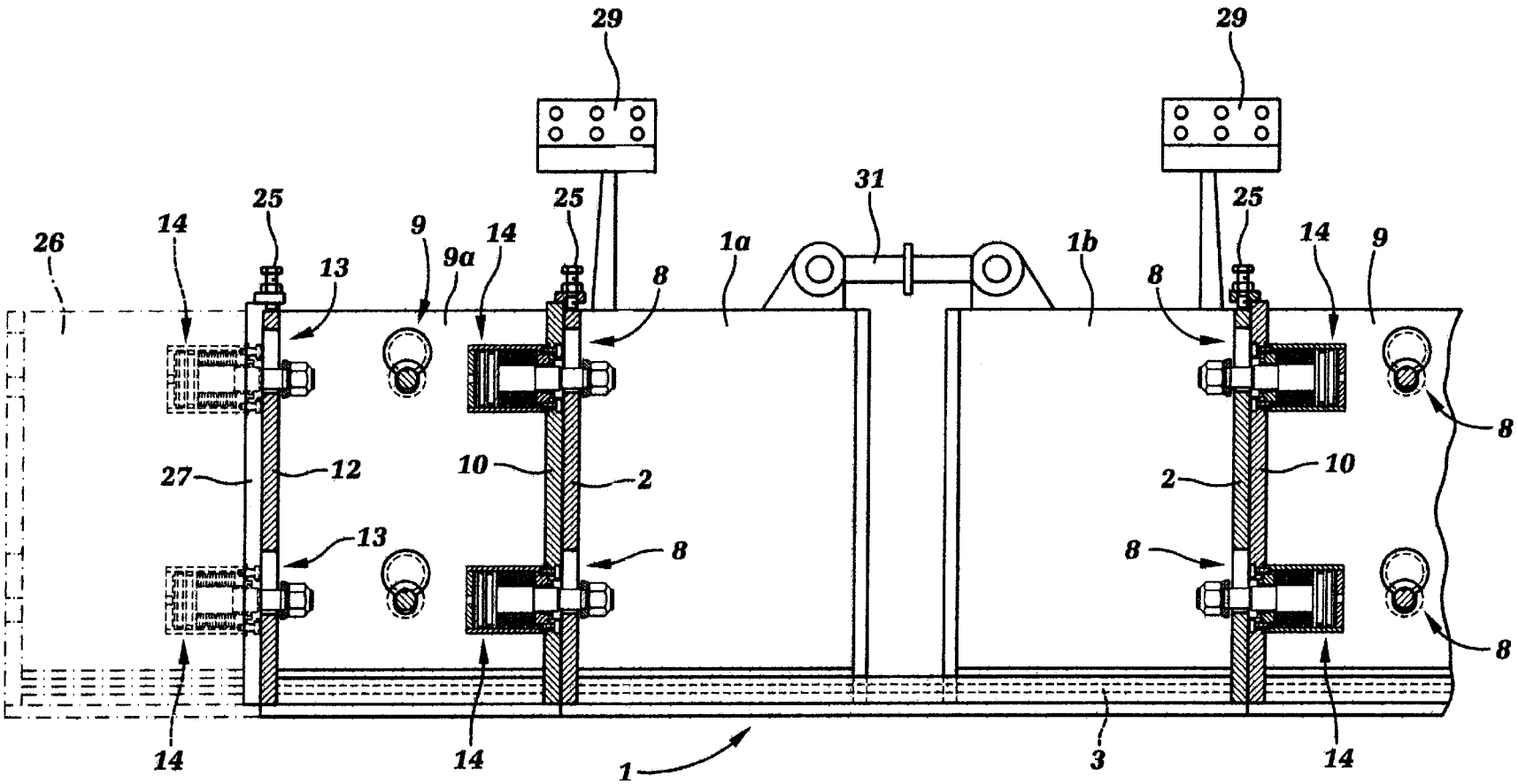
FIG. 5 is a partially broken-away, rear plan view of the screed assembly, showing the main screed halves and screed extensions mounted on both sides thereof.

Referring now to the drawings in detail, wherein like numbers are used to indicate like elements throughout, there is shown in FIGS. 1–5 a screed extension 9 (also referred to herein as a "screed lengthening part") for a screed assembly in accordance with the present invention. The screed assembly, as best shown in FIG. 5, preferably includes a main screed 1 having two screed halves 1*a*, 1*b* which are pivotable relative to one another transversely with respect to the paving direction (i.e., laterally) in order to form a roof profile. As shown in FIG. 2, the screed assembly may include extendible screed sections 1' connected with the main screed 1 so as to be laterally displaceable with respect to the main screed 1.

Referring to FIGS. 1, 2 and 5, each screed half 1*a*, 1*b* includes at least an outer side wall 2 and a baseplate 3. Preferably, as best shown in FIG. 1, a tamper bar 4 is arranged directly in front of the baseplate 3 with respect to the paving direction and extends transversely to the paving direction (i.e., laterally) over substantially the entire width of the baseplate 3. The tamper bar 4 is capable of being driven movably up and down by the amount of an adjustable stroke, for example by means of an eccentric drive (not illustrated). Further, the tamper bar 4 has a lead-in slope 5 at its front edge, the angle of the lead-in slope 5 being preferably between 30° and 70° in order to ensure an optimum feed of paving material. Alternatively, the main screed 1 may also have two tamper bars 4 arranged one behind the other with respect to the paving direction, may be designed as a pure vibrating screed or else may be provided with press bars (none shown).

Referring specifically to FIG. 1, each screed half 1*a* or 1*b* preferably has a front wall 6 proximal to a distributor auger (not shown) of the paver, the auger feeding the paving material to be leveled by the screed. The front wall 6 preferably comprises a lower guide portion 7 which is inclined relative to the tamper bar 4 and which terminates proximal to the bar 4. The angle of inclination of the guide portion 7 preferably corresponds approximately to the angle of the lead-in slope 5 of the tamper bar 4. Alternatively, if the screed assembly does not include a tamper bar, the front wall 6 may be constructed so as to extend substantially vertically (i.e., generally perpendicular to the base surface) without an inclined portion or may be constructed in any other desired, appropriate configuration.

Referring to FIGS. 1, 2 and 5, the side wall 2 of each main screed section 1*a*, 1*b* or 1' preferably has four insertion orifices 8, also referred to herein as "mounting holes" 8, extending through the side wall 2. Most preferably, the insertion orifices/mounting holes are disposed in the side wall 2 so as to generally form the corners of a square, as shown in FIG. 1. As discussed below, the insertion orifices/mounting holes 8 are configured to enable releasable mounting of a screed lengthening part 9 or screed extension 9 onto the particular section of the main screed 1. Preferably, as shown in FIGS. 1, 2 and 4, the insertion orifices 8 are of keyhole-like design. In other words, the portions of sidewall 2 bounding each orifice/mounting hole 8 have an overall shape similar to a standard key-hole, as best shown in FIG. 4.

Referring to FIGS. 2 and 5, each screed extension 9 includes a body 9*a* having a side wall 10 configured to be disposed adjacent to the side wall 2 of a main screed section 1*a*, 1*b* or 1'. The screed extension sidewall 10 is provided with bores 11 in positions which correspond to the insertion orifices 8 of the adjacent right-hand side wall 2 of the main screed section 1*a*, 1*b*, 1'. In other words, the bores 11 or through-holes 11 are located on the sidewall 10 such that, when the screed extension 9 is positioned adjacent to a section of the main screed 1, the bores 11 are generally aligned with the insertion orifices/mounting holes 8.

Further, the screed extensions 9 further include a side wall 12 located generally opposite the side wall 10. Preferably, the side wall 12 includes insertion orifices/mounting holes 13 that generally correspond to the insertion orifices 8 in a side wall 2 of the main screed 1. As shown in FIGS. 2 and 5, the mounting holes 13 enable another screed extension 26 to be mounted to a first screed extension 9 in the manner discussed above and in further detail below.

Figure 3:
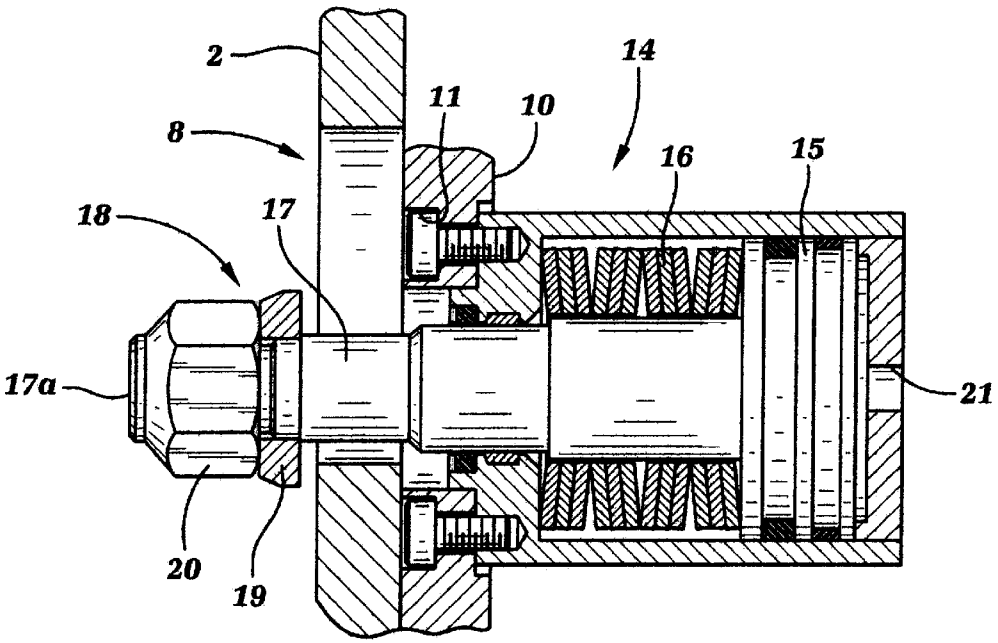
FIG. 3 is an enlarged, broken-away, rear cross-sectional view of the screed assembly, showing a hydraulic cylinder of the extension screed engaged with a mounting hole of the main screed.

Referring again to FIGS. 1–5, at least one and preferably four hydraulic cylinders 14 are fastened to the sidewall 10 of a screed extension 9. Preferably, the hydraulic cylinders 14 are each a "spring accumulator" cylinder 14. Each cylinder 14 has a piston 15 that is spring-loaded into an initial, retracted position by a compression spring 16, the spring 16 preferably being designed as a cup-spring assembly, as best shown in FIG. 3. The piston 15 preferably includes a shank 17 mounted to the piston 15 and which extends through a bore 11 in the side wall 10 when the cylinder 14 is attached to the sidewall 10. Further, the shank 17 has a free end 17*a* that is provided with an abutment element 18 or abutment portion 18. The abutment element/abutment portion 18 preferably comprises a spring ring 19, such as a "Belleville" type of spring, slipped onto the shank 17 and a nut 20 screwed onto the free end 17*a* of the shank 17. Alternatively to having a spring ring 19, a fork piece (not shown) may be mounted onto the piston shank 17, but such a fork piece should be secured onto the shank 17 by means such as a chain or similar device.

Furthermore, each of the hydraulic cylinders 14 includes, at an end facing away from the nut 20, a fluid inlet or connecting orifice 21 providing an inlet for a hydraulic line 22. Hydraulic fluid may be directed into the cylinders 14 so as to displace (i.e., extend) the piston 15 against the spring force or biasing action of spring 16. To enable hydraulic actuation of the cylinders 14, the hydraulic lines 22 may be connected to a hydraulic circuit on the main screed 1, for example to a distributor head 23 of a hydraulic cylinder 24, the distributor head 23 serving for the supply of oil or other hydraulic fluid, in order to adjust the main screed (an extending cylinder 24 for extending an extendable screed 1' of the screed half 1*b* being illustrated in FIGS. 1 and 2).

Preferably, the insertion orifices/mounting holes 8 are configured such that each orifice/hole 8 has an upper portion 8*a* sized to be sufficiently large to enable the abutment element/portion 18 to be inserted therethrough and a lower portion 8*b* that is sized to be sufficiently small such that the abutment element 18 is unable to move therethrough. To attach the screed extension 9 to the main screed 1, each cylinder 14 is actuated by hydraulic fluid flowing into the cylinder 14 such that the piston 15 is extended against the biasing action of the spring 16. With the piston 16 extended, the abutment element 18 is inserted through the upper portion 8*a* of a mounting hole 8, such that the abutment element 18 is disposed on one side of sidewall 2 and the remainder of the cylinder 14 is disposed on the opposing side of the sidewall 2. Next, the hydraulic cylinder 14, and thus the screed extension 9 on which the cylinder 14 is mounted, is moved, preferably downwardly, such that the shank 17 becomes disposed in the lower portion 8*b* of the mounting hole 8.

Thereafter, the piston 15 is retracted by evacuating hydraulic fluid from the cylinder 14, enabling the spring 16 to bias the abutment member 18 toward the remainder of the cylinder 14, and thereby against the portions of the sidewall 2 adjacent to the lower portion 8*b* of the mounting hole 8. Thus, the abutment portion 18 presses against the sidewall 2 to fasten the hydraulic cylinder 14 onto the sidewall 2, and thereby attach the screed extension 9 to a section 1*a*, 1*b* or 1' of the main screed 1. With the preferred screed extension 9 having a plurality of hydraulic cylinders 14, and most preferably four cylinders 14, the above-described mounting process is simultaneously performed with all of the hydraulic cylinders 14. The extension screed 9 is detached or removed from the main screed 1 by reversing the attachment steps described above.

Preferably, each screed extension 9 carries two adjusting screws 25, supported on the side wall 2 of the adjacent section of the main screed 1, for leveling the screed lengthening part 9 with the screed part 1 to be lengthened. In other words, each screed extension 9 includes two adjusting screws 25 (see FIG. 1) attached to the upper end of the sidewall 10 located such that the lower ends of the screws 25 contact the upper edge of the sidewall 2 of adjacent section of the main screed 1. The screws 25 are configured such that movement or adjustment of the screws 25 moves the screed extension 9 vertically with respect to connected section of the main screed 1. Thus, when the screed extension 9 is connected with the main screed 1, the hydraulic cylinders 14 may be actuated to extend the pistons 15, allowing the screws 25 to be able to move the screed extension 9 into a position leveled in relation to the baseplate 3. When the screed extension 9 is at a leveled position, the hydraulic cylinders 14 may be "bled" of hydraulic fluid, causing the screed extension 9 to be "braced" against or attached to the adjacent screed section 1*a*, 1*b* or 1', the bracing being releasable again as a result of the actuation of the cylinders 14 as discussed above.

The screed assembly may be further lengthened by attaching additional screed lengthening parts 26 or screed extensions 26. Each additional screed extension 26 has a side wall 27 having bores 28 (i.e., through-holes 28) located in the wall 27 at positions which correspond to or align with the insertion orifices/mounting holes 13 in the side wall 12 of the screed extension 9.

Referring particularly to FIG. 2, with a screed assembly that includes one or more extendible screed sections 1' mounted to the main screed 1, the hydraulic cylinders 14 may be fluidly connected to a supply of oil (or other hydraulic fluid) of a hydraulic cylinder 24 used for moving the extendible screed 1' with respect to the main screed 1. Preferably, the hydraulic cylinders 14 are capable of being activated or controlled by means of an existing external control panel 29 of the screed assembly. As shown in FIG. 1, to enable coupling of the hydraulic cylinders 14 on the screed extensions 9 and/or 26 to the hydraulic cylinder 24 located in the hydraulic circuit of the screed assembly, a distributor head 23 is preferably mounted onto the respective side wall 10, 27 of each screed extension 9, 26. Each distributor head 23 is coupled to all of the hydraulic cylinders 14 on the associated screed extension 9, 26 by hydraulic lines 22 and is connectable to the hydraulic cylinder 24 by a hydraulic hose 30.

As shown in FIG. 5, screed extensions 9 may be mounted on both screed halves 1*a*, 1*b*, which in FIG. 5 are configured to be non-extendible, and may be additionally lengthened by means of additional screed extensions 26 (only one shown on left-hand side of FIG. 5). With this configuration of the main screed 1, a leveling hydraulic cylinder 31 coupled to both screed halves 1*a*, 1*b* serves for pivoting the screed halves 1*a*, 1*b* relative to one another in order to form a roof profile of the screed assembly. With a screed assembly having a leveling hydraulic cylinder 31, the hydraulic cylinders 14 on the screed extensions 9 or 26 are preferably fluidly connectable with the supply of oil/hydraulic fluid of the leveling cylinder 31.

The screed extensions 9, 26 of the present invention have a number of advantages over known screed extensions. As a result of fastening the extensions 9, 26 by means of hydraulic cylinders 14, the time necessary to fit a screed extension onto a main screed 1 is appreciably reduced and much less effort is required. As discussed above, a screed extension 9 is merely placed adjacent to the main screed 1, the pistons 15 of the cylinders 14 are each extended by a flow of hydraulic fluid into the cylinders 14, the shanks 17 are inserted into the mounting holes 8, and then the screed extension 9 becomes fixedly attached to the main screed 1 merely by bleeding the hydraulic cylinders 14 to retract the abutment members 18 against the main screed sidewall 2. Further, the hydraulic cylinders 14 preferably utilize a supply of hydraulic fluid already existing in hydraulic circuit on the screed assembly, thereby reducing assembly time and utilizing components already existing on the screed assembly.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A screed for a paver, the screed having a hydraulic circuit and two outer side walls, at least one of the side walls being provided with an insertion orifice configured for releasable mounting of at least one lateral screed lengthening part, and a screed lengthening part with a fastening element capable of being inserted through the insertion orifices, wherein the fastening element comprises a spring accumulator cylinder, the cylinder having a piston spring-loaded into an initial position, being actuatable hydraulically to displace the piston against the spring load and connectable to a hydraulic circuit of the screed, and a shank mounted to the piston, capable of being inserted through the insertion orifice and being providable with an abutment element.

2. The screed according to claim 1, wherein the spring accumulator cylinder is connectable to an oil supply of a leveling cylinder of two screed halves which are pivotable relative to one another.

3. The screed according to claim 1, wherein the spring cylinders are connectable to a hydraulic cylinder for extending an extendable screed capable of being extended in relation to a basic screed.

4. The screed according to claim 1, wherein the supply of pressure oil to the spring accumulator cylinders is activatable via an external control panel of the screed.

5. The screed according to claim 1, wherein a distributor head is premounted on at least one side wall of the screed and is coupled to each of the spring accumulator cylinders via hydraulic lines.

6. The screed according to claim 1, wherein the insertion orifices in at least one side wall of the screed are of keyhole-like design with an upper portion for the passage of the abutment element.

7. The screed according to claim 1, wherein the abutment element comprises a nut and a spring ring.

8. The screed according to claim 1, wherein the screed lengthening part carries two adjusting screws, supported on the side wall of the screed, for leveling the screed lengthening part with the screed part to be lengthened.

9. A screed extension on a screed assembly having a main screed with two outer side walls, at least one of the side walls having at least one mounting hole, and a hydraulic circuit disposed on the main screed, the screed extension comprising:

a body having a sidewall; and a hydraulic cylinder mounted on the sidewall, connectable to the hydraulic circuit of the main screed and having a piston, the piston being spring-loaded into an initial position and having a shank with an abutment portion engageable with the mounting hole of the main screed so as to connect the screed extension with the main screed.

10. The screed extension as recited in claim 9, wherein the hydraulic circuit of the screed assembly includes a supply of hydraulic fluid and the hydraulic cylinder is connectable to the supply of hydraulic fluid.

11. The screed extension as recited in claim 10 wherein the main screed includes two pivotally connected screed halves and a hydraulic cylinder for leveling the two screed halves with respect to each other, the hydraulic cylinder of the main screed being the supply of hydraulic fluid for the screed extension hydraulic cylinder.

12. The screed extension as recited in claim 9, wherein the screed assembly includes an extendible screed movably attached to the main screed and including a hydraulic cylinder configured to move the extendible screed with respect to the main screed, the screed extension hydraulic cylinder being fluidly connectable with the hydraulic cylinder of the extendible screed.

13. The screed extension as recited in claim 9, wherein the main screed includes a control panel and a source of hydraulic fluid that is fluidly connectable with the hydraulic cylinder, the fluid source being activatable by the control panel.

14. The screed extension as recited in claim 9 further including at least one other hydraulic cylinder mounted on the sidewall.

15. The screed extension as recited in claim 14, wherein the screed extension includes a distributor head mounted on the side wall of the screed extension and connected with each hydraulic cylinder by a separate hydraulic line.

16. The screed extension as recited in claim 9, wherein the mounting hole on the main screed is configured so as to have a keyhole shape and includes an upper portion sized to enable the abutment portion to pass through the mounting hole.

17. The screed extension as recited in claim 9, wherein the abutment portion includes a nut and a spring ring.

18. The screed extension as recited in claim 9 further comprising at least one adjusting screw mounted on the side wall of the screed extension and configured for leveling the screed extension with respect to the main screed.

* * * * *